US008513556B2

(12) United States Patent
Kitahara et al.

(10) Patent No.: US 8,513,556 B2
(45) Date of Patent: Aug. 20, 2013

(54) PUSH SWITCH

(75) Inventors: Takahisa Kitahara, Isesaki (JP); Toshiyuki Muto, Isesaki (JP); Kenji Mizushima, Yokohama (JP)

(73) Assignees: Tokyo Parts Industrial Co., Ltd., Isesaki-shi, Gunma (JP); Alpha Corporation, Yokohama-shi, Kanagawa (JP)

( * ) Notice: Subject to any disclaimer, the term of this patent is extended or adjusted under 35 U.S.C. 154(b) by 151 days.

(21) Appl. No.: 13/258,639

(22) PCT Filed: Apr. 6, 2010

(86) PCT No.: PCT/JP2010/056262

§ 371 (c)(1),
(2), (4) Date: Sep. 22, 2011

(87) PCT Pub. No.: WO2010/117005

PCT Pub. Date: Oct. 14, 2010

(65) Prior Publication Data

US 2012/0024681 A1 Feb. 2, 2012

(30) Foreign Application Priority Data

Apr. 6, 2009 (JP) ..... 2009-091749

(51) Int. Cl.
*H01H 3/12* (2006.01)

(52) U.S. Cl.
USPC ..... 200/341

(58) Field of Classification Search
USPC ..... 200/341, 302.2, 520, 302.1, 329, 200/333, 345, 330, 52 R
See application file for complete search history.

(56) References Cited

U.S. PATENT DOCUMENTS

| | | | | |
|---|---|---|---|---|
| 5,172,114 | A * | 12/1992 | Bedoya et al. | 341/27 |
| 5,199,557 | A * | 4/1993 | Brandt et al. | 200/406 |
| 7,012,208 | B2 * | 3/2006 | Wang | 200/341 |
| 8,089,014 | B2 * | 1/2012 | Maeda et al. | 200/302.1 |
| 2007/0235312 | A1 | 10/2007 | Takeuchi | |

FOREIGN PATENT DOCUMENTS

| | | |
|---|---|---|
| JP | 2007/280742 | 10/2007 |
| JP | 2009-9823 | 1/2009 |
| JP | 2009-54380 | 3/2009 |

* cited by examiner

*Primary Examiner* — Edwin A. Leon
(74) *Attorney, Agent, or Firm* — Drinker Biddle & Reath LLP

(57) ABSTRACT

A push switch (1) includes an internal button (40), an external button (10), a switch (30) disposed inside the internal button (40), a casing (50) fixed to a side wall (43) of the internal button (40), an inner collar portion (51) provided in the casing (50) and engaged with a groove portion (46) of the internal button (40), an overhanging portion (17) formed in the external button (10), and an outer collar portion (47) formed in the internal button (40) and located between the overhanging portion (17) and the inner collar portion (51) so as to define apart of the groove portion (46). The overhanging portion (17) is disposed separately from the outer collar portion (47) by a gap. The overhanging portion (17) abuts against the outer collar portion (47) when the external button (10) is pushed to elastically deform the internal button (40) to thereby turn on the switch (30).

3 Claims, 6 Drawing Sheets

PUSH SWITCH

TECHNICAL FIELD

The present invention relates to a push switch.

BACKGROUND ART

As a background-art push switch, there is a switch operation device which is mounted in a vehicle in use and operated to be pushed from the outside (Patent Document 1). As shown in FIG. 7, this switch operation device is provided with a switch 103 having a movable portion 102 and soldered and fixed onto a circuit board 101, a casing 105 having an opening hole 104 and disposed in front of the switch 103, and a push button 106 attached to the casing 105 at a circumferential edge of the opening hole 104 so as to close the opening hole 104.

This push button 106 is made from synthetic rubber with flexibility and has an attachment portion 109 which is attached to the circumferential edge of the opening hole 104, a pressing operation portion 110, a thin flexible portion 111 which connects the pressing operation portion 110 with the attachment portion 109, and a shaft portion 112 which can move the movable portion 102 of the switch 103 due to the pressing of the pressing operation portion 110. The push button 106 makes the inside of the casing 105 watertight. To operate this switch operation device, the pressing operation portion 110 of the push button 106 is pressed or released from pressing in the illustrated up/down direction so as to turn on/off the switch 103.

However, in the aforementioned push switch, because the push button is made from a soft material, there is a fear that the push button may be cracked or broken if the push button is hit by something hard such as a nail when the push button is pushed by a finger or the like. In addition, the whole pressing force of an operator acts on the switch when the operator operates the push button of the push switch. Thus, there is a fear that the switch may be damaged if an excessive pressing force is applied to the push button of the push switch.

Further, when the pushbutton of the push switch is operated, the push button is not always pushed only from the illustrated up/down direction, but there is possibility that the push button may be pushed from any direction. When, for example, the push button is pushed from an illustrated obliquely lateral direction, there is a fear that a lower end of the shaft portion of the push button may move horizontally due to a certain way of the operator's pressing so that the pressing force cannot be applied to the switch correctly.

PRIOR ART DOCUMENT

Patent Document

Patent Document 1: JP-A-2009-009823

SUMMARY OF INVENTION

One or more embodiments of the invention provide a push switch which can prevent a pushbutton from being damaged even if the push button is hit by a nail or the like when the push button is operated, and which can protect a switch even if an operating force with an excessive load is applied.

In addition, one or more embodiments of the invention provide a push switch which can push a switch from any direction.

According to one or more embodiments of the invention, a push switch 1 is provided with: a soft internal button 40 which includes a side wall 43 and an upper wall 42 and has an opening portion 48 formed in a lower surface thereof; an external button 10 which is formed of a hard material, which includes a side circumferential wall 12 and an upper operation wall 11, and which is fixed to the internal button 40 so as to cover the internal button 40; a switch substrate 20 which is disposed in the opening portion 48 of the internal button 40; a switch 30 which is disposed on the switch substrate 20 and inside the internal button 40; a casing 50 which is fixed to the side wall 43 of the internal button 40; a groove portion 46 which is formed in an outer circumference of the side wall 43 of the internal button 40; an inner collar portion 51 which is provided in the casing 50 and engaged with the groove portion 46 of the internal button 40; an overhanging portion 17 which is formed in the external button 10 and which includes a substantially flat pressing surface 18 provided in an end portion of the side circumferential wall 12; and an outer collar portion 47 which is formed in the internal button 40 and which is located between the overhanging portion 17 and the inner collar portion 51 and adjacently to the inner collar portion 51 and defines a part of the groove portion 46. The overhanging portion 17 is disposed oppositely to the inner collar portion 51. The overhanging portion 17 is disposed separately from the outer collar portion 47 by a gap. The overhanging portion 17 abuts against the outer collar portion 47 when the external button 10 is pushed to elastically deform the internal button 40 to thereby turn on the switch 30.

In the above structure, the inner collar portion 51 of the casing 50 may be formed inward from an inner side of the casing 50 at least in a portion corresponding to the pressing surface 18 of the overhanging portion 17 of the external button 10.

In the above structure, a pressing portion 44 protruding both upward and downward substantially at a center of the upper wall 42 of the internal button 40 may be provided integrally with the internal button 40. An upper end surface of the pressing portion 44 may face the upper operation wall 11 of the external button 10. A lower end surface of the pressing portion 44 may face an operation portion 31 of the switch 30. The lower end surface of the pressing portion 44 of the internal button 40 may abut against an upper end surface of the operation portion 31 of the switch 30 even when a pressing force from an obliquely lateral direction is applied to the external button 10.

According to the above structure, the external button which is hard is disposed to cover the internal button which is soft. Thus, the internal button can be protected even if a nail or the like hits the external button. In addition, even if an excessive pressing force is applied, the overhanging portion of the external button abuts against the outer collar portion of the internal button when the external button is pushed by a stroke (corresponding to the gap between the overhanging portion and the outer collar portion) to turn on the switch. Thus, the pressing force on the external button is received by the inner collar portion of the casing. It is therefore possible to provide a high-reliable push switch which can protect a switch without applying any excessive pressing force to the switch.

Other aspects and advantages of the invention will be apparent from the following description and the appended claims.

BRIEF DESCRIPTION OF DRAWINGS

FIG. 3(*b*) is a sectional view of the push switch in FIG. 2, taken on line G-G.

DESCRIPTION OF EMBODIMENTS

An embodiment of the invention will be illustratively described below with reference to the drawings. Unless specific description is made particularly, there is no intention of limiting the scope of the invention to materials, shapes, relative locations, etc. of constituent components described in this embodiment.

Figure 1:
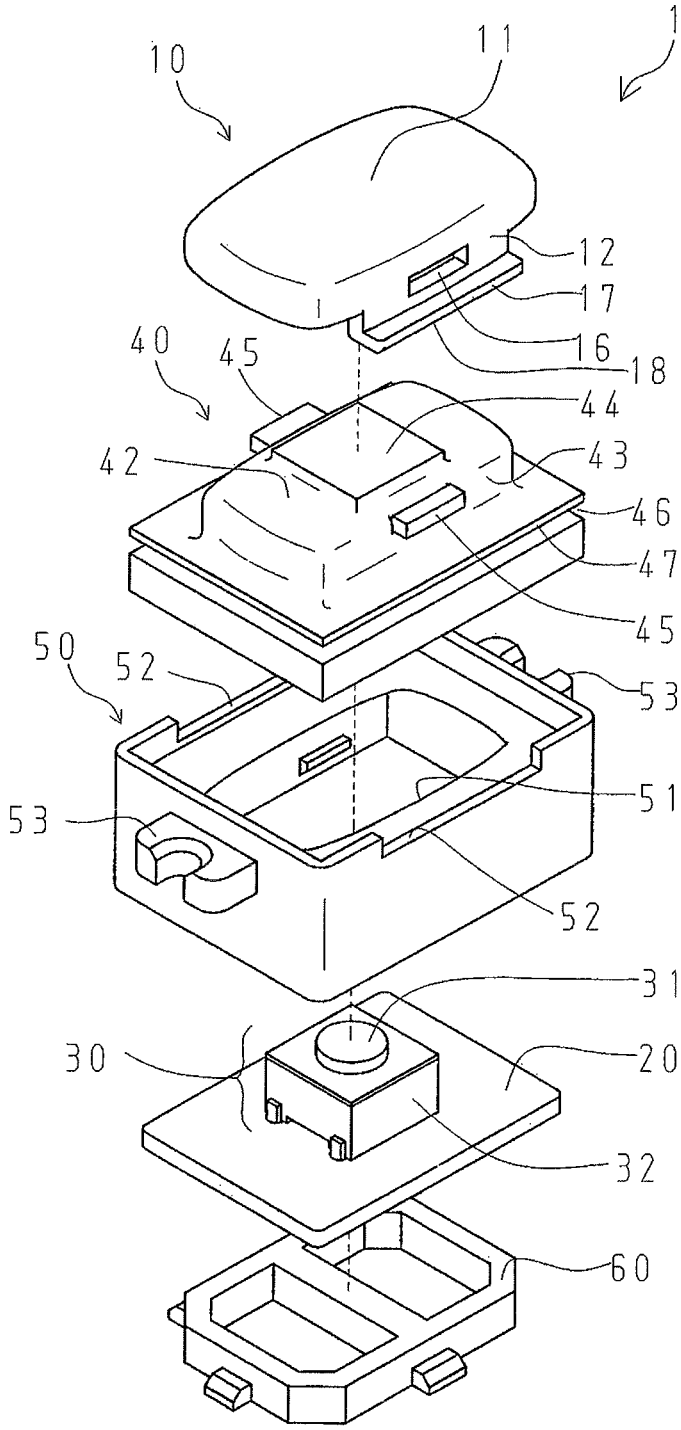
FIG. 1 is an exploded perspective view of a push switch according to an exemplary embodiment of the invention.
Figure 2:
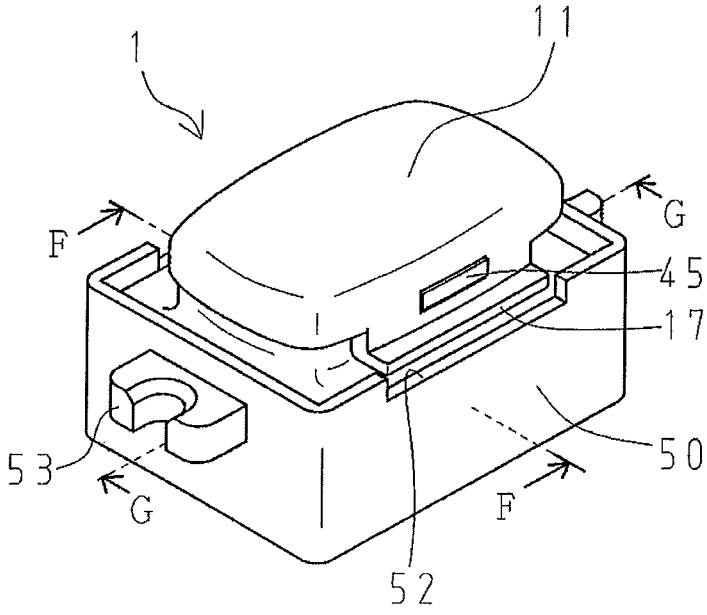
FIG. 2 is a final perspective view of the push switch in FIG. 1.
Figure 3A:
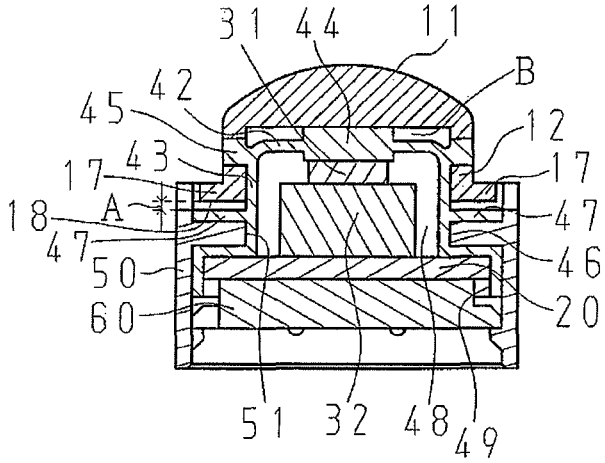
FIG. 3(*a*) is a sectional view of the push switch in FIG. 2, taken on line F-F.
Figure 3B:
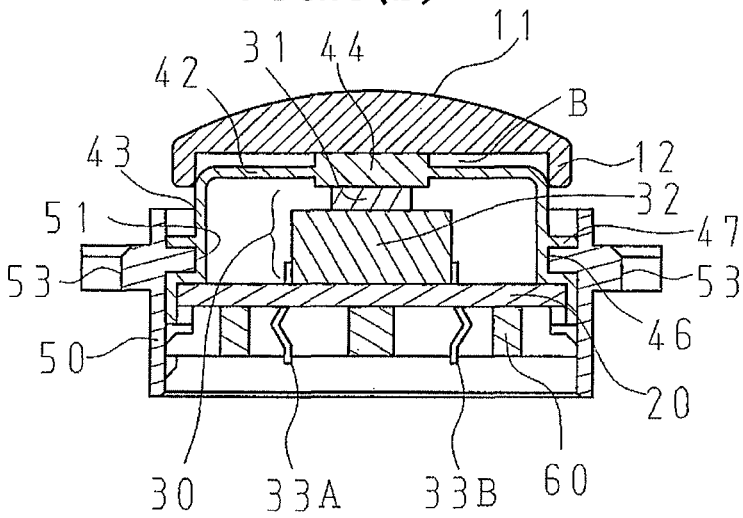
Figure 4:
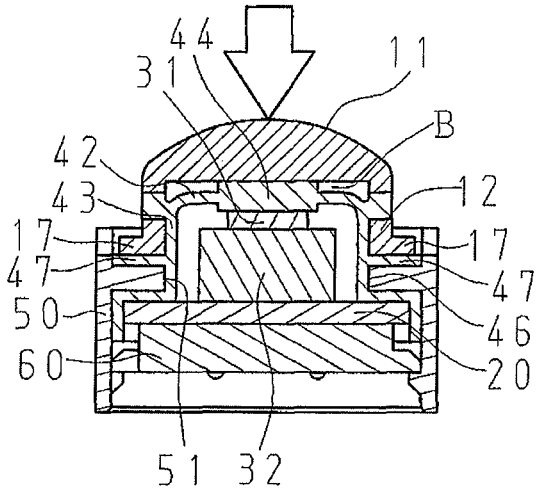
FIG. 4 is a first operation sectional view of the push switch in FIG. 3(*a*).
Figure 5:
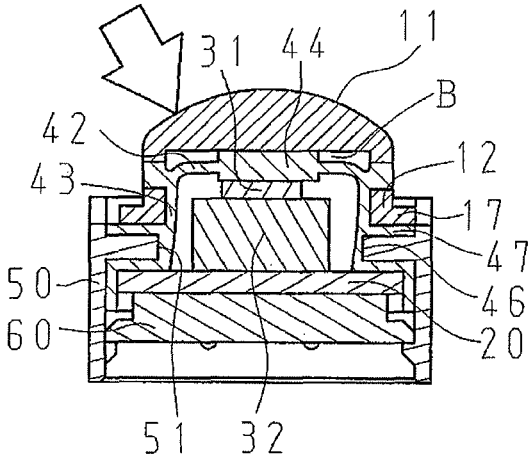
FIG. 5 is a second operation sectional view of the push switch in FIG. 3(*a*).

FIG. 1 is an exploded perspective view of a push switch according to an exemplary embodiment of the invention. FIG. 2 is a final perspective view of the push switch in FIG. 1. FIG. 3(*a*) is a sectional view of the push switch in FIG. 2, taken on line F-F. FIG. 3(*b*) is a sectional view of the push switch in FIG. 2, taken on line G-G. FIG. 4 is a first operation sectional view of the push switch in FIG. 3(*a*). FIG. 5 is a second operation sectional view of the push switch in FIG. 3(*a*).

In FIG. 1 to FIG. 3(*b*), a push switch 1 is attached to an opening hole of a not-shown door handle unit for a vehicle. An external button 10 of the push switch 1 is attached to the opening hole of the door handle unit so as to be exposed to the outside. When the external button 10 is pushed by a finger or the like, a door can be locked or unlocked.

The push switch 1 has the external button 10, a switch substrate 20, a switch 30, an internal button 40, a casing 50 and a stopper 60.

The external button 10 is formed out of hard resin with rigidity, and has a substantially quadrangular upper operation wall 11, aside circumferential wall 12 which is provided erectly around the upper operation wall 11, and two overhanging portions 17 which protrude outward from end portions of the side circumferential wall 12 parallel with each other in the longitudinal direction of the push switch 1 respectively, and which have substantially flat pressing surfaces 18 respectively.

The internal button 40 is formed out of soft resin of silicone rubber. Not to say, the rigidity of the internal button 40 is lower than the rigidity of the external button 10. In addition, the hardness of the internal button 40 is lower than the hardness of the external button 10. The internal button 40 has a substantially quadrangular upper wall 42, a side wall 43 provided erectly around the upper wall 42, and an opening portion 48 formed in its lower surface. A groove portion 46 is provided all over an outer circumference of the side wall 43 of the internal button 40.

The insulating switch substrate 20 is mounted in a step portion 49 inside the side wall 43 of the internal button 40. The stopper 60 is locked in the casing 50 from a lower surface of the switch substrate 20.

On the switch substrate 20, the switch 30 having an operation portion 31 and a body portion 32 is disposed inside the internal button 40, so that a signal of the switch 30 can be transmitted to the outside through connection terminals 33A and 33B.

The operation portion 31 of the switch 30 is urged toward the illustrated upper side. When the operation portion 31 is pushed toward the illustrated lower side, a sense of click is obtained and electric continuity is secured between not-shown contact points. When the operation portion 31 is released from the pressing force, the operation portion 31 is restored to its original state so that electric discontinuity between the contact points is obtained. Thus, the switch 30 can be turned on/off.

A substantially rectangular-parallelepiped pressing portion 44 which protrudes integrally in the illustrated up and down directions is formed substantially at the center of the upper wall 42 of the internal button 40, as shown in FIGS. 3(*a*) and FIG. 3(*b*). (The pressing portion 44 protrudes both upward and downward from the upper wall 42.) Opposite, upper and lower end surfaces of the pressing portion 44 are disposed closely to or in contact with an inner wall of the upper operation wall 11 of the external button 10 and an end surface of the operation portion 31 of the switch 30 so as to be opposed thereto, respectively. The lower end surface of the pressing portion 44 has a wider area than the end surface of the operation portion 31 of the switch 30, so that the lower end surface of the pressing portion 44 can always abut against all the end surface of the operation portion 31 of the switch 30 even if a pressing force from an obliquely lateral direction is applied to the external button 10.

The casing 50 is formed out of hard resin and into a substantially quadrangular cylinder. The casing 50 has an inner collar portion 51 engaged with the groove portion 46 around the side wall 43 of the internal button 40. The inner collar portion 51 is formed to protrude inward from an inner side of the casing 50 at least correspondingly to the pressing surfaces 18 of the overhanging portions 17 of the external button 10. The inner collar portion 51 may be provided inward from the inner side of the casing 50 and in the whole circumference of the casing 50, so that water droplets can be prevented from entering the casing 50 even if the water droplets adhere to a gap between the internal button 40 and the casing 50. Mounting holes 53 for mounting the push switch 1 on a door handle unit are provided outside the casing 50.

The aforementioned external button 10 is disposed to cover the outside of the internal button 40 while securing a space B around the pressing portion 44, while holes 16 of the side circumferential wall 12 of the external button 10 are fitted to protrusion portions 45 of the side wall 43 of the internal button 40 so as to fix the external button 10 to the internal button 40. Thus, the internal button 40 can be protected even if a nail or the like hits the external button 10 when the external button 10 is operated and pushed.

As shown in FIG. 3(*a*), each overhanging portion 17 of the external button 10 is disposed oppositely to the inner collar portion 51 of the casing 50 and closely to an outer collar portion 47 through a gap A. The outer collar portion 47 is provided between the overhanging portion 17 and the inner collar portion 51 and adjacently to the inner collar portion 51 so as to form a part of the groove portion 46 of the internal button 40. The gap A between the overhanging portion 17 of the external button 10 and the outer collar portion 47 of the internal button 40 is made substantially equal to a stroke between a place where the external button 10 is operated and pushed and a place where the pressing portion 44 is elastically deformed to turn on the switch 30.

When the external button 10 is pushed from the illustrated upper side toward the illustrated lower side in the push switch 1 configured as described above according to this embodiment, the external button 10 is pushed toward the illustrated lower side to elastically deform the pressing portion 44 of the internal button 40 as shown in FIG. 4, while the pressing portion 44 pushes the operation portion 31 downward to turn on the switch 30 (the state of FIG. 4).

On this occasion, an excessive pressing force maybe applied as an external force to the external button 10. Even in such a case, when the external button 10 is pushed correspondingly to the stroke of the external button (the gap A between each overhanging portion and the outer collar portion) to turn on the switch 30, the overhanging portions 17 of the external button 10 abut against the outer collar portion 47 of the internal button 40 so that the pressing force of the external button 10 can be received by the inner collar portion 51 of the casing 50. Thus, the switch can be protected without any excessive pressing force applied to the thereto.

When the pressing force is not applied to the external button 10 anymore, the pressing portion 44 of the internal button 40 is elastically recovered so that the external button 10 and the operation portion 31 can return to their initial positions (the state of FIG. 3(*a*)). Thus, the switch 30 is disconnected. After that, cyclical operation can be performed.

In this manner, according to the structure of the exemplary embodiment of the invention, the hard external button is disposed to cover the soft internal button so that the internal button can be protected even if a nail or the like hits the external button. In addition, an excessive pressing force may be applied to the external button. Even in such a case, when the external button is pushed correspondingly to a stroke (the gap between each overhanging portion and the outer collar portion) to turn on the switch, the overhanging portions of the external button abut against the outer collar portion of the internal button so that the pressing force of the external button can be received by the inner collar portion of the casing. As a result, it is possible to provide a high-reliable push switch which can protect the switch without applying any excessive pressing force to the switch.

In addition, the inner collar portion 51 of the casing 50 is formed inward from the inner side of the casing 50 at least in portions corresponding to the pressing surfaces 18 of the overhanging portions 17 of the external button 10. Thus, the overhanging portions 17 of the external button 10 abut against the inner collar portion 51 of the casing 50 so that the pressing force of the external button 10 can be received by the inner collar portion 51 of the casing 50. As a result, it is possible to surely protect the switch without applying any excessive pressing force to the switch.

In addition, each overhanging portion 17 of the external button 10 is disposed oppositely to the inner collar portion 51 of the casing 50 and separately from the outer collar portion 47 by a gap. The outer collar portion 47 is provided between the overhanging portion 17 and the inner collar portion 51 and adjacently to the inner collar portion 51 so as to form a part of the groove portion 46 of the internal button 40. Thus, even when an excessive pressing force is applied to the external button 10 suddenly, the overhanging portions 17 of the external button 10 abut against the soft outer collar portion 47 so that the pressing force applied to the inner collar portion 51 of the casing 50 can be relaxed.

In addition, the external button 10 is fixed to the outside of the soft internal button 40 so as to cover the internal button 40 while securing a space B around the pressing portion 44. Thus, a sense of click generated when an operator operates and pushes the external button 10 can be transmitted to the operator substantially without being attenuated. The operator can confirm the switch operation surely.

In addition, a portion (the inner collar portion 51) for receiving an excessive pressing force applied to the external button 10 is provided in the casing 50. Thus, it is not necessary to provide this reception portion in the internal button 40. Accordingly, the space inside the internal button 40 can be reduced so that the push switch can be miniaturized as a whole.

In addition, as shown in FIG. 5, the lower end surface of the pressing portion 44 of the internal button 40 abuts against the end surface of the operation portion 31 of the switch 30 even if a pressing force from an obliquely lateral direction is applied to the external button 10. Accordingly, even if the external button 10 is pushed from any direction, the pressing portion 44 of the internal button 40 can be elastically deformed so that the pressing portion 44 can push the operation portion 31 downward to turn on the switch 30 surely.

On this occasion, an excessive pressing force may be applied as an external force to the external button 10. Even in such a case, the overhanging portions 17 of the external button 10 abut against the inner collar portion 51 of the casing 50 so that the external button 10 can be pushed correspondingly to a stroke (the gap A between each overhanging portion and the outer collar portion) to turn on the switch 30. In addition, the overhanging portions 17 of the external button 10 abut against the outer collar portion 47 so that the pressing force of the external button 10 can be received by the inner collar portion 51 of the casing 50. As a result, it is possible to protect the switch without applying any excessive pressing force to the switch.

When the pressing force is not applied to the external button 10 anymore, the pressing portion 44 of the internal button 40 is elastically recovered so that the external button 10 and the operation portion 31 can return to their initial positions (the state of FIG. 3(*a*)). Thus, the switch 30 is disconnected. After that, cyclical operation can be performed.

Figure 6:
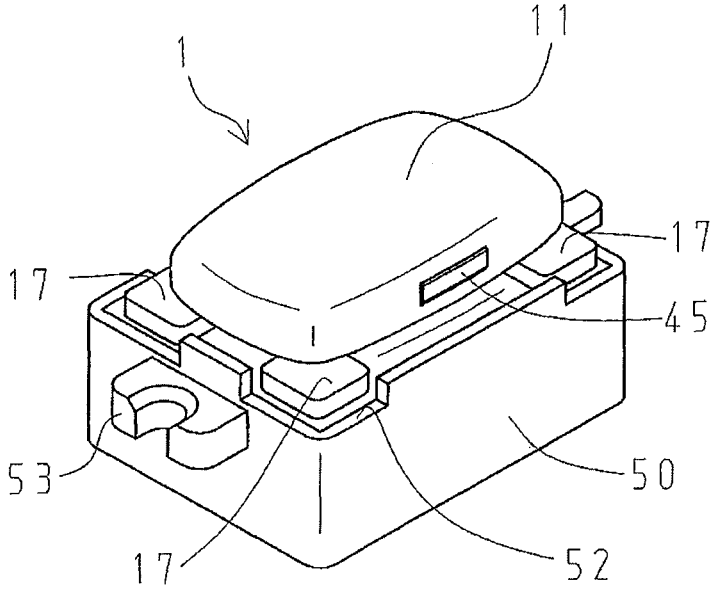
FIG. 6 is a modification of the push switch of the exemplary embodiment of the invention.
Figure 7:
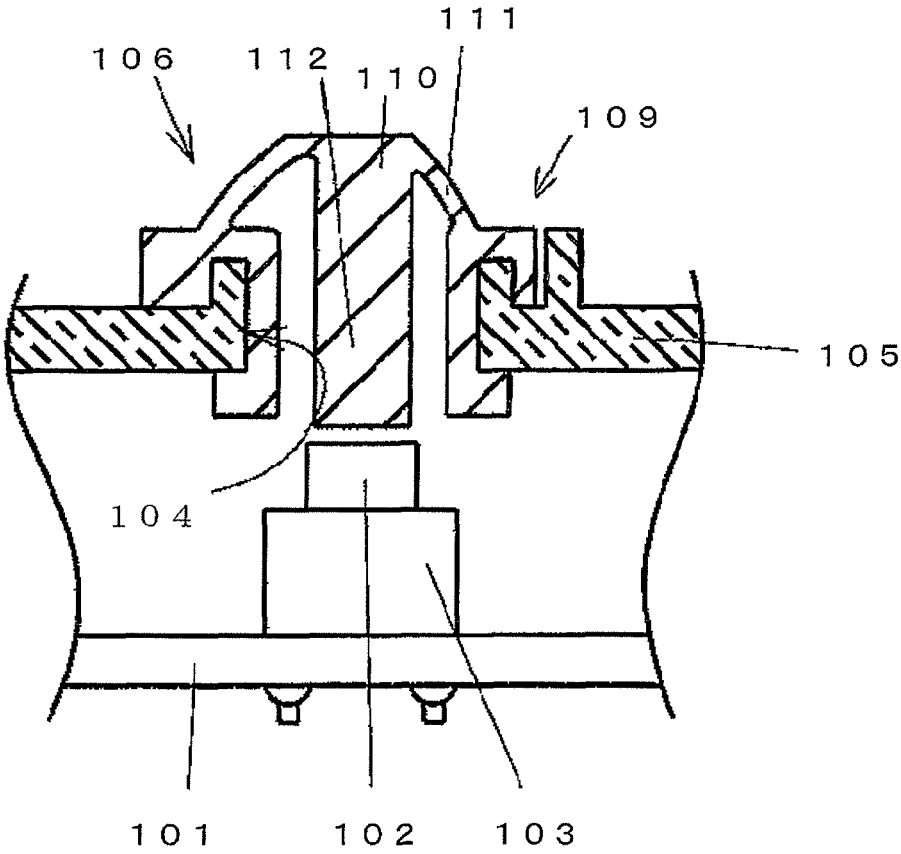
FIG. 7 is a sectional view of a background-art push switch.

In the push switch 1 according to the aforementioned exemplary embodiment, two overhanging portions 17 are provided in the external button 10, and the inner collar portion 51 corresponding to the overhanging portions 17 is provided in the casing 50. However, similar effect to the aforementioned effect can be obtained when four overhanging portions 17 are provided in corners of the substantially quadrangular upper operation wall of the external button 10 and the inner collar portion 51 corresponding to the overhanging portions 17 is provided in the casing 50, as shown in FIG. 6.

As described above, the invention is not limited to the aforementioned embodiment, but it may be carried out with any suitable change without departing from the gist of the invention.

INDUSTRIAL APPLICABILITY

The invention is applicable to a push switch.

DESCRIPTION OF REFERENCE NUMERALS AND SIGNS

1 push switch
10 external button
11 upper operation wall
12 side circumferential wall
16 hole
17 overhanging portion
18 pressing surface
20 switch substrate
30 switch
31 operation portion
32 body portion
33A connection terminal
33B connection terminal

40 internal button
42 upper wall
43 side wall
44 pressing portion
45 protrusion portion
46 groove portion
47 outer collar portion
48 opening portion
49 step portion
50 casing
51 inner collar portion
53 mounting hole
60 stopper
101 circuit board
102 movable portion
103 switch
104 opening hole
105 casing
106 push button
109 attachment portion
110 pressing operation portion
111 flexible portion
112 shaft portion
A gap
B gap

The invention claimed is:

1. A push switch comprising:

a soft internal button which includes a side wall and an upper wall and has an opening portion formed in a lower surface thereof;

an external button which is formed of a hard material, which includes a side circumferential wall and an upper operation wall, and which is fixed to the internal button so as to cover the internal button;

a switch substrate which is disposed in the opening portion of the internal button;

a switch which is disposed on the switch substrate and inside the internal button;

a casing which is fixed to the side wall of the internal button;

a groove portion which is formed in an outer circumference of the side wall of the internal button;

an inner collar portion which is provided in the casing and engaged with the groove portion of the internal button;

an overhanging portion which is formed in the external button and which includes a substantially flat pressing surface provided in an end portion of the side circumferential wall; and an outer collar portion which is formed in the internal button and which is located between the overhanging portion and the inner collar portion and adjacently to the inner collar portion and defines a part of the groove portion, wherein the overhanging portion is disposed oppositely to the inner collar portion, wherein the overhanging portion is disposed separately from the outer collar portion by a gap, and wherein the overhanging portion abuts against the outer collar portion when the external button is pushed to elastically deform the internal button to thereby turn on the switch.

2. The push switch according to claim 1, wherein the inner collar portion of the casing is formed inward from an inner side of the casing at least in a portion corresponding to the pressing surface of the overhanging portion of the external button.

3. The push switch according to claim 1, further comprising:

a pressing portion which is provided integrally with the internal button substantially at a center of the upper wall of the internal button so as to protrude both upward and downward, wherein an upper end surface of the pressing portion faces the upper operation wall of the external button , and a lower end surface of the pressing portion faces an operation portion of the switch, and wherein the lower end surface of the pressing portion of the internal button abuts against an upper end surface of the operation portion of the switch even when a pressing force from an obliquely lateral direction is applied to the external button.

* * * * *